US006241626B1

(12) United States Patent
Sullivan et al.

(10) Patent No.: US 6,241,626 B1
(45) Date of Patent: Jun. 5, 2001

(54) GOLF BALL CONTAINING PLASTOMER AND METHOD OF MAKING SAME

(75) Inventors: Michael J. Sullivan, Chicopee; R. Dennis Nesbitt, Westfield; Mark Binette, Ludlow, all of MA (US)

(73) Assignee: Spalding Sports Worldwide, Inc., Chicopee, MA (US)

( * ) Notice: Subject to any disclaimer, the term of this patent is extended or adjusted under 35 U.S.C. 154(b) by 0 days.

(21) Appl. No.: 09/455,068

(22) Filed: Dec. 6, 1999

Related U.S. Application Data

(60) Division of application No. 08/743,122, filed on Nov. 4, 1996, now Pat. No. 6,018,003, which is a continuation-in-part of application No. 08/495,062, filed on Jun. 26, 1995, now Pat. No. 5,830,087.

(51) Int. Cl.[7] ..... A63B 37/06

(52) U.S. Cl. ..... 473/377; 473/351; 473/378; 522/333.8

(58) Field of Search ..... 473/351, 365, 473/377, 378, 385, 372

(56) References Cited

U.S. PATENT DOCUMENTS 5,830,087 * 11/1998 Sullivan et al. ..... 473/385
5,971,870 * 10/1999 Sullivan et al. ..... 473/385
6,018,003 * 1/2000 Sullivan et al. ..... 473/378

* cited by examiner

*Primary Examiner*—Mark S. Graham
*Assistant Examiner*—Raeann Gorden

(57) ABSTRACT

The invention provides golf balls formed from plastomers which have a molecular weight distribution of 4 or less. Plastomers can be included in the cores of multi-piece balls and in the mantle of multi-layer golf balls in crosslinked or uncrosslinked form, and can be used to form golf ball covers and one-piece golf balls when the outer surface of the ball is crosslinked. Golf balls which employ these compositions as covers have high durability as well as good cut resistance.

35 Claims, 2 Drawing Sheets

GOLF BALL CONTAINING PLASTOMER AND METHOD OF MAKING SAME

This is a divisional of U.S. application Ser. No. 08/743,122 filed on Nov. 4, 1996 (C.P.A filed Oct. 26, 1998) which is U.S. Pat. No. 6,018,033.

This application is a continuation-in-part of U.S. application Ser. No. 08/495,062 filed Jun. 26, 1 995now U.S. Pat. No. 5,830,087.

1. Field of the Invention

The invention generally relates to golf balls, and more particularly to golf balls having cores and/or covers made of plastomers.

2. Background of the Invention

Golf balls comprise, in general, three types. The first type is a wound ball wherein a vulcanized rubber thread is wound under tension around a solid or semi-solid core, and thereafter enclosed in a single or multi-layer covering of tough, protective material. A second type of golf ball is a one-piece ball formed from a solid mass of moldable resilient material which has been cured to develop the necessary degree of hardness to provide utility. One-piece molded balls do not have an enclosing cover. A third type of ball is a multi-piece (two or more piece) non-wound ball which includes a solid or liquid core of one or more layers and a cover having one or more layers formed over the core.

While for many years the wound ball satisfied the standards of both the U.S.G.A. and most golfers, it has several disadvantages. For example, a wound ball is difficult to manufacture due to the number of production steps required and the careful control which must be exercised in each stage of manufacture to achieve suitable roundness, velocity or rebound, "click", "feel" and the like. "Click" is the term applied to the sound produced by the ball when dropped on a hard surface or when struck with a golf club. "Feel" refers to how impact of the ball is transmitted through the club to the hands of the golfer. In addition, the balata cover material for the wound ball is susceptible to cutting when struck by a golf club.

The one-piece ball and the core for a multi-piece non-wound ball frequently are formed from a combination of materials such as polybutadiene, zinc diacrylate or zinc dimethacrylate, fillers and curing agent s which are molded under high pressure and temperature to provide a ball of suitable hardness and resiliene. One-piece balls are described, for example, in U.S. Pat. No. 3,313,545, U.S. Pat. No . 3,373,123 and U.S. Pat. No. 3,384,612. Multi-piece non-wound golf balls typically have a cover which contains a substantial quantity of ionomer. Useful ionomers include those sold by E.I. DuPont de Nemours Company under the name Surlyn as well as those sold by Exxon under the name lotek™. The use of ionomers in golf ball covers imparts toughness and cut resistance to the covers. It would be useful to develop golf ball covers which contain substantial quantities of non-ionomeric materials and which have the durability and other playability properties of ionomeric golf ball covers. Furthermore, it would be useful to develop durable one-piece golf balls having reduced quantities of polybutadiene.

SUMMARY OF THE INVENTION

An object of the invention is to provide a golf ball containing reduced quantities of ionomer.

Yet another object of the invention is to provide a golf ball containing reduced quantities of polybutadiene.

A further object of the invention is to provide a golf ball having playability characteristics similar to those of golf balls with ionomeric covers while containing reduced quantities of ionomer.

Yet another object of the invention is to provide a golf ball having a cover containing a non-ionomeric resin which is comparable in durability to a cover made from ionomeric resin.

Yet another object of the invention is to provide a non-ionomeric golf ball.

Another object of the invention is to provide a golf ball which does not contain polybutadiene.

A further object of the invention is to provide a high quality restricted flight golf ball.

Another object of the invention is to provide a method of making a golf ball using non-ionomeric materials.

A further object of the invention is to provide a method of making a golf ball product having reduced quantities of ionomer.

A further object of the invention is to provide a method of making a golf ball product having reduced quantities of polybutadiene.

Other objects will be in part obvious and in part pointed out more in detail hereafter.

In accordance with the invention, novel golf balls of excellent durability, click and feel are provided. In a preferred form, the invention is a golf ball comprising plastomer with a molecular weight distribution of about 1.5–4 and a composition distribution breadth index of greater than 30%, the golf ball having a coefficient of restitution of at least 0.600. One particularly preferred form of the invention is a golf ball having a core which comprises a plastomer. The plastomer can be cured (crosslinked) or uncured (uncrosslinked). Another particularly preferred form of the invention is a wound or non-wound golf ball having a cover comprising a plastomer. If plastomer is present at the outer surface of the ball, it is cured. Yet another particularly preferred form of the invention is a one-piece golf ball comprising a plastomer. The plastomer in at least the outer surface of the one-piece ball is cured. Furthermore, the plastomer throughout the thickness of the ball can be cured.

The plastomer used to form the golf ball preferably is a copolymer formed from ethylene. More preferably the plastomer is a copolymer of ethylene and at least one of butene, hexene and octene.

By crosslinking plastomer at the outer surface of the ball, the ball is provided with good cut resistance, thereby meeting the playability standards of commercial golf balls. While any peroxide curing agent having an activation temperature higher than the melting point of the plastomer can be used if the plastomer is to be cured, e.g. a one hour half life at 112° C. or higher, a preferred curing agent is 4,4 bis(tert-butylperoxy) butylvalerate having about 40% peroxide content.

The curing or crosslinking agent is employed in an amount appropriate to impart to the golf ball a crosslink density which is sufficient to provide the desired cut resistance, scuff resistance and surface hardness to the outside of the ball. In a one-piece ball, the amount of peroxide is sufficient to provide a usable compression, i.e. 60–110 PGA compression in addition to appropriate cut resistance, scuff resistance and hardness. A plastomer core or an inner cover layer of a multi-layer ball may not require crosslinking or curing.

Another preferred form of the invention is a method of making a golf ball product comprising forming a mixture comprising a plastomer with a molecular weight distribution of about 1.5–4 and a composition distribution breadth index of at least 30%, the quantity of plastomer being appropriate to form a golf ball product having a coefficient of restitution of at least 0.600, and molding the mixture to form a golf ball product. The golf ball product is a golf ball core, a one-piece golf ball, or a multi-piece golf ball with plastomer in at least one of the core and cover. Preferably, the mixture includes a curing agent for curing the plastomer.

Further scope of the applicability of the present invention will become apparent from the detailed description given hereinafter. It should, however, be understood that the detailed description and specific examples, while indicating preferred embodiments of the invention, are given by way of illustration only, since various changes and modifications within the spirit and scope of the invention will become apparent to those skilled in the art.

DETAILED DESCRIPTION OF THE INVENTION

The golf balls of the invention comprise olefin copolymers with a uniform, narrow molecular weight distribution, a high comonomer content, and an even distribution of comonomers, referred to as plastomers. The molecular weight distribution of the plastomers generally is about 1.5–4, preferably 1.5–3.5 and more preferably 1.5–2.4. The density is typically in the range of 0.85–0.97 if unfoamed and 0.10–0.90 if foamed. The comonomer content typically is in the range of 1–32%, and preferably 2–20%. The composition distribution breadth index generally is greater than 30%, preferably is at least 45%, and more preferably is at least 50%. Preferably the golf balls also include a crosslinking agent for the plastomer.

The term "copolymer" includes (1) copolymers having two types of monomers which are polymerized together, (2) terpolymers (which are formed by the polymerization of three types of monomers), and (3) copolymers which are formed by the polymerization of more than three types of monomers. The compositions of the invention further may include additives and fillers as well as a co-agent for use with a curing agent to aid in crosslinking the plastomer or to improve proccessability.

The "composition distribution breadth index" (CDBI) is defined as the weight percent of the copolymer molecules which have a comonomer content within 50 percent of the median total molar comonomer content.

Plastomers are polyolefin copolymers developed using metallocene single-site catalyst technology. Plastomers exhibit both thermoplastic and elastomeric characteristics. In addition to being comprised ot a polyolefln, plastomers generally contain up to about 32 wt % comonomer. When the plastomer is used in a one-piece ball or a golf ball cover, it is of a type which can be crosslinked. At least the outer surface portion of the one-piece ball or golf ball outer cover in a thickness of 3–6 mm should be crosslinked to provide the ball with good cut resistance. Preferably, in order to obtain a maximum C.O.R. and other good playability properties, the entire one-piece ball or outer cover layer of a multi-piece ball is crosslinked. Cores which contain plastomer preferably, but not necessarily, are crosslinked. Plastomers which are useful in making golf balls include but are not limited to ethylene-butene copolymers, ethylene-octene copolymers, ethylene-hexene copolymers, and ethylene-hexene-butene terpolymers, as well as mixtures thereof. Blends of these plastomers with olefinic elastomers such as butadiene, preferably a high content of cis-polybutadiene, also may be employed in the invention.

Figure 1:
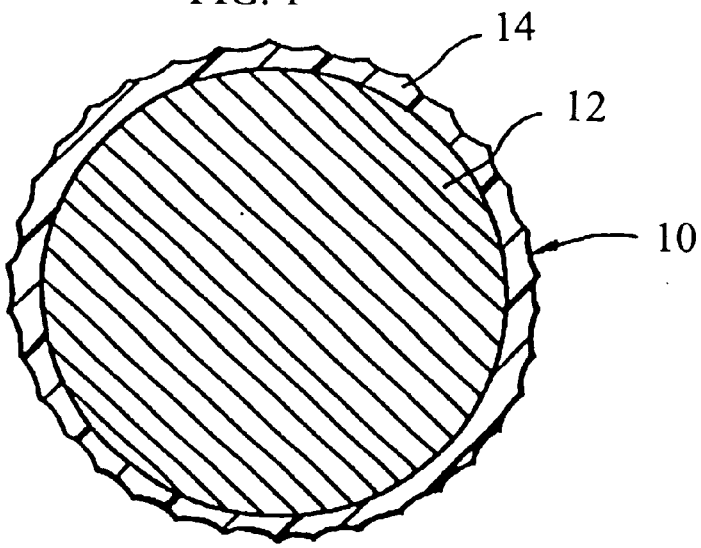
FIG. 1 shows a two-piece golf ball according to the invention.
Figure 2:
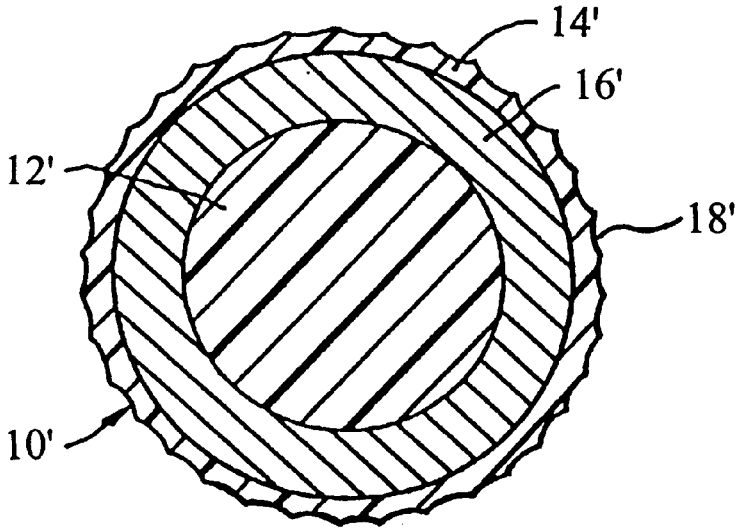
FIG. 2 shows a three-piece golf ball according to the invention.
Figure 3:
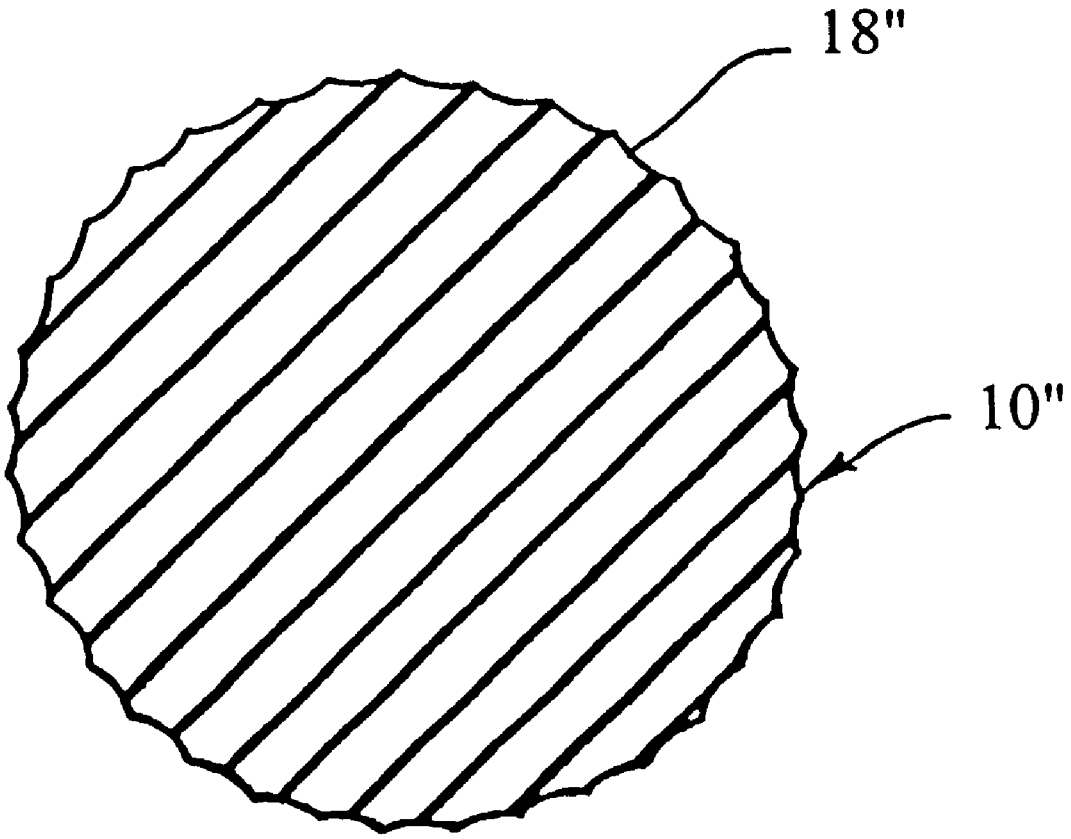
FIG. 3 shows a one-piece golf ball according to the invention.

The golf balls of the invention are one-piece, two-piece or multi-layer balls. Non-limiting examples of golf balls according to the invention are shown in FIGS. 1–3. FIG. 1 shows a two-piece ball 10 with a plastomer-containing core 12, which can be crosslinked or uncrosslinked, and a plastomer-containing cover 14, at least the outer surface 18 of which is crosslinked. FIG. 2 shows a three-piece ball 10' with a core 12', an uncrosslinked plastomer-containing mantle 16', and a plastomer-containing cover 14', at least the outer surface 18' of which is crosslinked. FIG. 3 shows a one-piece ball 10" comprising plastomer. At least the outer surface 18" of the ball 10" is crosslinked.

The plastomers employed in the invention preferably are formed by a single-site metallocene catalyst such as those disclosed in EP 29368, U.S. Pat. No. 4,752,597, U.S. Pat. No. 4,808,561, and U.S. Pat. No. 4,937,299, the teachings of which are incorporated herein by reference. As is known in the art, plastomers can be produced by metallocene catalysis using a high pressure process by polymerizing ethylene in combination with other monomers such as butene-1, hexene-1, octene-1 and 4-methyl-1-pentene in the presence of catalyst system comprising a cyclopentadienyl-transition metal compound and an alumoxane.

Non-limiting examples of plastomers which are especially useful in the invention include linear ethylene-butene copolymers such as EXACT 3024 having a density of about 0.905 gms/cc (ASTM D-1505) and a melt index of about 4.5 g/10 min. (ASTM D-2839); EXACT 3025 having a density of about 0.910 gms/cc (ASTM D-1505) and a melt index of about 1.2 g/10 min. (ASTM D-2839); EXACT 3027 having a density of about 0.900 gms/cc (ASTM D-1505) and a melt index of about 3.5 g/10 min. (ASTM D-2839); EXACT 4011 having a density of about 0.887 gms/cc (ASTM D-1505) and a melt index of about 2.2 g/10 min. (ASTM D-2839); and EXACT 4049 having a density of about 0.873 gms/cc (ASTM D-1505) and a melt index of about 4.5 g/10 min. (ASTM D-2839); and ethylene-hexene copolymers such as EXACT 3031 having a density of about 0.900 gms/cc (ASTM D-1505) and a melt index of about 3.5 g/10 min. (ASTM D-2839). Other non-limiting examples of useful EXACT plastomers are EXACT 4005 and EXACT 5010. Terpolymers of e.g. ethylene, butene and hexene also can be used. All of the above EXACT series plastomers are available from EXXON Chemical Co.

EXACT plastomers typically have a molecular weight distribution ($M_w/M_n$) of about 1.5 to 2.4, where $M_w$ is weight average molecular weight and $M_n$ is number average molecular weight, a density of about 0.86 to about 0.91 g/cc, preferably about 0.87 g/cc to about 0.91 g/cc, a molecular weight of about 5,000 to about 50,000, preferably about 20,000 to about 30,000, a melting point of about 140–220° F., and a melt index above about 0.50 g/10 mins, preferably about 1–10 g/10 mins as determined by ASTM D-1238, condition E. Plastomers which may be employed in the invention include copolymers of ethylene and at least one $C_3$–$C_{20}$ α-olefin, preferably a $C_4$–$C_8$ α-olefin present in an amount of about 5 to about 32 mole %, preferably about 7 to about 22 mole %, more preferably about 9–18 mole %.

These plastomers are believed to have a composition distribution breadth index of about 45% or more.

Plastomers such as those sold by Dow Chemical Co. under the tradename ENGAGE also may be employed in the invention. These plastomers are believed to be produced in accordance with U.S. Pat. No. 5,272,236, the teachings of which are incorporated herein in their entirety by reference. These plastomers are substantially linear polymers having a density of about 0.85 gms/cc to about 0.97 g/cc measured in accordance with ASTM D-792, a melt index ("MI") of about 0.01 gms/10 minutes to about 1000 grams/10 minutes, a melt flow ratio ($I_{10}/I_2$) of about 7 to about 20, where $I_{10}$ is measured in accordance with ASTM D-1238 (190/10) and $I_2$ is measured in accordance with ASTM D-1238 (190/2.16), and a molecular weight distribution $M_w/M_n$ which preferably is less than 5, and more preferably is less than about 3.5 and most preferably is from about 1.5 to about 2.5. These plastomers include homopolymers of $C_2$–$C_{20}$ olefins such as ethylene, propylene, 4-methyl-1-pentene, and the like, or they can be interpolymers of ethylene with at least one $C_3$–$C_{20}$ α-olefin and/or $C_2$–$C_{20}$ acetylenically unsaturated monomer and/or $C_4$–$C_{18}$ α-olefins. These plastomers generally have a polymer backbone that is either unsubstituted or substituted with up to 3 long chain branches/1000 carbons. As used herein, long chain branching means a chain length of at least about 6 carbons, above which the length cannot be distinguished using $^{13}C$ nuclear magnetic resonance spectroscopy. The preferred ENGAGE plastomers are characterized by a saturated ethylene-octene backbone, a narrow molecular weight distribution $M_w/M_n$ of about 2, and a narrow level of crystallinity. These plastomers also are compatible with pigments, brightening agents, fillers such as carbon black, calcium carbonate and silica, as well as with plasticizers such as paraffinic process oil and naphthenic process oil. Other commercially available plastomers may be useful in the invention, including those manufactured by Mitsui.

The molecular weight distribution, ($M_w/M_n$), of plastomers made in accordance with U.S. Pat. No. 5,272,236 most preferably is about 2.0. Non-limiting examples of these plastomers include ENGAGE CL 8001 having a density of about 0.868 gms/cc, a melt index of about 0.5 g/10 mins, and a Shore A hardness of about 75; ENGAGE CL 8002 having a density of about 0.87 gms/cc, a melt index of about 1 gms/10 min, Shore A hardness of about 75; ENGAGE CL 8003 having a density of about 0.885 gms/cc, melt index of about 1.0 gms/10 min, and a Shore A hardness of about 86; ENGAGE EG 8100 having a density of about 0.87 gms/cc, a melt index of about 1 gms/10 min., and a Shore A hardness of about 87; ENGAGE 8150 having a density of about 0.868 gms/cc, a melt index of about 0.5 gms/10 min, and a Shore A hardness of about 75; ENGAGE 8200 having a density of about 0.87 gms/cc, a melt index of about 5 g/10 min., and a Shore A hardness of about 75; and ENGAGE EP 8500 having a density of about 0.87 gms/cc, a melt index of about 5 g/10 min., and a Shore A hardness of about 75.

When the plastomer is used in a one-piece ball or in the outer cover of a multi-piece ball, it is crosslinked at the outer surface, and preferably throughout the plastomer-containing thickness, in order to provide the surface of the ball with good cut resistance. Surface-crosslinking can be effected using electron beam treatment and the like. Commercially available curing agents useful in the compositions of the invention when the entire plastomer-containing layer is to be crosslinked include but are not limited to di-tert-butyl peroxide, dicumyl peroxide, benzoyl peroxide, 2,4-dichlorobenzoyl peroxide, t-butyl-cumyl peroxide, t-butyl perbenzoate, t-butyl peroxide, t-butylperoxy (2-ethyl hexanoate), 2,5-dimethyl-2,5-di(benzoylperoxy)-hexane, benzoyl peroxide, 2,5-dimethyl-2,5-(6-butylperoxy)-hexane, 1,1-di-t-butylperoxy-3,3,5-trimethyeloyclohexane, 4,4-di-t-butylperoxy n-butyl valerate, 4,4 bis(-t-butylperoxy) butylvalerate, preferably 4,4 bis(-t-butylperoxy) butylvalerate having a peroxide content of 40%, which is sold as Trigonox 17/40 by Akzo Chemicals Inc. (Chicago, Ill.) and Luperco 230-XL by Elf Atochem North America, Inc. (Philadelphia, Pa.).

Coagents which may be used with the aforementioned curing agents include, for example, zinc diacrylate, zinc dimethacrylate, zinc monomethacrylate, trimethylol propane triacrylate, trimethylol propane trimethacrylate, vinyl, allyl, methallyl, furfuryl, crotyl and cinnamyl esters of the following acids: oxatic, maioic, succinic, glutaric, adipic, pimelic, suberic, azelaic, sebacic, maleic, itaconic, citraconic, mesaconic, fumaric, aconitic, phthalic, isophthalic, terephthalic, naphthalene, dicarboxylic mellitic, pyromellitic, trimesic, acrylic methacrylic, cennamic, and crotonic. Other coagents which may be employed include di- and triallyl cyanurate, di- and triallylmelamine, divinyl benzene; diallyl benzene; diallyl amine; allyl ether; allyl gycolates; di, tri and tetravinyl and allyl silanes, as well as polyamides and imides of maleic, itaconic, acrylic, methacrylic crotonic, citaconic, aconitic and cinnamic acid as well as polyol esters and anhydrides of acrylic methacrylic, crontic and cinnamic acids. All of these co-agents are commercially available.

When plastomeric compositions are employed as one piece balls or in centers or covers for multi-piece balls, filler materials can be employed in the compositions to control the weight of the ball and increase hardness or compression. Fillers which may be employed are in finely divided form, for example, in a size generally less than about 20 mesh, preferably less than about 100 mesh U.S. standard size. The filler preferably is a precipitated hydrated silica such as that sold under the trademark HiSil by the Pittsburgh Plate Glass Company. Other fillers which may be employed include, but are not limited to, clay, talc, asbestos, graphite, glass, mica, calcium metasilicate, barium sulfate, zinc sulfide, aluminum hydroxide, silicates, diatomaceous earth, carbonates such as calcium carbonate, magnesium carbonate and the like, metals and metal alloys, such as titanium, tungsten, aluminum, bismuth, nickel, molybdenum, iron, copper, brass, boron, bronze, cobalt and beryllium, and alloys of the above metals, metal oxides such as zinc oxide, iron oxide, aluminum oxide, titanium oxide, magnesium oxide, zirconium oxide and the like, particulate synthetic plastic such as high molecular weight polyethylene, polystyrene, polyethylene ionomer resins and the like, particulate carbonaceous materials such as carbon black, natural bitumen and the like, as well as cotton flock, cellulose flock, and leather fiber. Dark colored fillers generally are not preferred for use in outer cover compositions if a white ball is desired. The amount of filler employed is primarily a function of weight restrictions.

The compositions of the invention also may include various processing aids and activators known in the rubber and molding arts such as fatty acids. Useful processing aids include fatty acids having from about 10 to about 40 carbon atoms, preferably from about to about 20 carbon atoms. Examples of useful fatty acids include stearic acid and linoleic acid, as well as mixtures thereof. The fatty acid may be present in the compositions of the invention in amounts of from about 1 to about 15, preferably from about 2 to about 5 parts by weight per 100 parts olefin elastomer. Other processing aids and activators include, for example, calcium stearate, barium stearate, zinc stearate, lead stearate, basic lead sulfite, dibasic lead phosphite, dibutyl tin dilaurate, dibutyltin dimaleate, and dibutyltin mercaptide.

Coloring pigments and optical brighteners also may be included in the compositions of the invention. Useful coloring pigments include, for example, titanium dioxide, the presence of which simplifies the surface painting operation of the finished ball.

The plastomer-containing golf balls of the invention have a coefficient of restitution of at least 0.600, preferably at least 0.700, and more preferably at least 0.740, a PGA compression of about 60–110 and preferably 80–90, a ball size of 1.680"–1.750", and a ball weight of 45.93 grams or less. Furthermore, non-USGA approved balls may be made exceeding USGA limits.

When plastomer is used in a core or an inner cover layer of a multi-layer golf ball, it is not necessary to crosslink the cover layer. In formulating one-piece balls and golf ball outer cover compositions of the invention, about 100 parts by weight plastomer and about 1 to about 10 parts by weight, and more preferably about 2–10 parts by weight of an initiator, such as 4,4 bis (tert-butylperoxy) butylvalrate having 40% peroxida thioroin, preferably are employed. If a curing or crosslinking agent optionally is used in forming a core or an inner cover layer for a multi-piece ball, it generally is employed in an amount of about 1–10 parts by weight of 40% active peroxide per 100 parts by weight of plastomer. Alternatively, the curing agent can be omitted and the outer surface of the core, or the entire core, can be treated by electron beam treatment or the like to induce crosslinking.

When forming a one-piece ball or a center for a two-piece ball, the amount of filler which can be employed in these compositions is primarily a function of weight restrictions on the ball. Preferably, the filler is included in amounts of from about 10 to about 100 parts by weight per 100 parts by weight of plastomer. Processing aids and activators such as fatty acids, metal stearates and the like may be employed in these compositions in amounts of from about 1 to about 15, preferably in amounts of from about 2 to about 5 parts by weight per 100 parts by weight of plastomer.

Wide latitude may be taken in the production of balls from the compositions of the invention to provide balls of various compressions suitable for every type of golfer. Low compression balls, generally preferred by "soft" hitters, may be made by increasing the proportion of the olefin copolymer component. Medium compression balls, preferred by average golfers, may be made by balancing the quantities of the olefin copolymer, co-agent and peroxide initiator. High compression balls preferred by "hard" hitters may be made by increasing the proportion of co-agent and peroxide curing agent.

In producing compositions useful as golf balls, the components are intimately mixed, using, for example, a two roll mill or an internal mixer such as a Banbury® mixer until the mixture is uniform. This usually can be accomplished in a period of from about 5 to about 20 minutes. A preferred mixing sequence is one wherein the metallocene catalyzed olefin copolymer is mixed for about 5 minutes in a Banbury® mixer. The curing agent (if used), co-agent and fillers are then added, whereafter mixing is continued for about one minute, whereupon the batch is discharged onto a two roll mill, mixed for about an additional minute and formed into a sheet. The temperature of the mixing is not critical, but should, of course, be below the curing temperature. Mixing is usually done at room temperature, although, through friction, the ingredients will be slightly warmed.

The resulting composition can be formed into one-piece golf balls and centers for multi-piece balls by any one of a variety of known techniques such as injection, compression or transfer molding. When one-piece cured balls or plastomer-containing cured cores are desired, a preform of the composition of the invention can be compression molded and cured under heat and pressure between two halves of a compression press mold. If a one-piece ball is being formed, the mold has dimpled golf ball cavities therein. The volume of the preform portion placed in the mold cavity is slightly in excess of the actual volume of the ball cavity to enable the cavity to be completely filled when the mold is closed. Thus, an extrudate or flash of excess composition typically is formed at the mating surfaces of the closed cavities. Typically the composition is compression molded at about 290° F. to about 330° F., preferably about 315° F., under a pressure of about 100–500 PSI, preferably about 500 PSI. The time required for curing is normally about 10 minutes to about 20 minutes, preferably about 14 minutes depending upon the amount and activity of the selected curing agent and any co-agents.

After curing, the resulting golf balls or cores are cooled for about 10 minutes in the mold by circulating cold water through the mold. If a core has been made, the core optionally can be subjected to known centerless grinding operations whereby a thin layer of the molded center is removed. The center can be converted into a two-piece ball by providing a layer of covering material thereon.

If a cured one-piece ball or a cured core for a multi-layer ball is made with plastomer by injection molding, the one-piece ball or core material is injected into a hot mold at 140–200° C., maintained at this temperature for about 2 to 8 minutes, and is then removed hot.

If an uncured or surface-cured one-piece golf ball or core is made by compression molding according to the invention, the ball or core is molded at 250–350° F. and 100–500 p.s.i. using steam for 1–5 minutes, followed by 10 minutes of cooling. If injection molding is used, the material for the core or ball is heated to 300–400° F. and injection molded into a cold mold where it remains for about 1–5 minutes for cooling. If surface crosslinking is desired, the compression-molded or injection-molded core or one-piece ball can be subjected to electron beam treatment or the like.

If a multi-piece ball with plastomer-containing inner and/or outer cover layers is desired, a center or core formed of a composition of the invention as described above, or a polybutadiene or other solid single or multi-piece core, wound or liquid core, or other type of suitable core is obtained. The center or core optionally may be covered with one or more non-plastomer inner cover layers prior to application of one or more plastomer cover layers. Cured or uncured plastomer can be used as an inner cover layer. If necessary, the core can be surface treated to facilitate adhesion thereof to a cover composition. Surface treatment can be performed by techniques known in the art, such as corona discharge, ozone treatment, sand blasting, grinding and the like. Useful non-plastomer cover compositions for inner or outer cover layers include blends of ethylene-acrylic acid or ethylene-methacrylic acid, as well as copolymers neutralized with mono-or divalent metals such as sodium, potassium, lithium, calcium, zinc or magnesium. Such compositions are shown in U.S. Pat. No. 5,368,304, the disclosure of which is incorporated herein in its entirety by reference.

The plastomer cover layer or layers can be formed using a conventional molding technique, such as compression molding or injection molding. When a plastomer cover layer is peroxide cured and compression molded, the cover composition, after mixing in a Banburyo®-type internal mixer, can be formed into half-shells, e.g., 0.812 inch radius male and 0.865 inch radius female smooth cavity molds. The half-shells are molded for about five minutes in a steam heated mold at a temperature sufficient to form the half shell but without activating the curing agent. Typically, these temperatures are less than about 250° F. The molded half shells are then placed over an, e.g., 1.545 inch ground center positioned within a 1.725 inch mold that has dimpled cavities. The center with the half-shells thereon then is molded for about fifteen minutes in a steam heated mold at 280–320° F. at 100 PSI, and then cooled for 6 minutes while under pressure in the mold.

When a plastomer cover layer is uncured as with an inner cover layer or is surface-cured and is made by compression molding, the golf ball center is placed between two half-shells and the ball is molded for about 1–3 minutes at 200–300° F. and 100 p.s.i. Subsequently, the molded ball is cooled for about 10 minutes. The surface of the cover is cured by election beam treatment or the like, if desired.

When a plastomer cover layer is cured and is made by injection molding, the cover material is preheated in the barrel to about 200–250° F. and is then injection molded into a hot mold having a temperature of 280–380° F., where it is maintained for about 1–5 minutes and is then removed hot. Alternatively, injection-molded ½ shells can be compression molded at 280–320° F. and 100–500 p.s.i. using steam for 5–15 minutes, followed by 5–10 minutes of cooling.

When a plastomer cover layer is uncured or is surface cured and is made by injection molding, the cover material is heated to 300–400° F. and injection molded into a cold mold where it is maintained for about 20–60 seconds. The cover can be surface cured in the manner described above.

The golf balls of the invention have a cut resistance which is sufficiently good to meet playability standards. The "Guillotine Cut Test" employed to measure cut resistance is performed by holding an unfinished ball firmly in a cavity to expose the top half of the ball. A guillotine blade weighing 5 pounds and having inner and outer blade edge angles of 90° and 60° relative to the horizontal, respectively, and a blunt cutting edge of three sixty-fourths inch radius which is designed to simulate the leading edge of an iron is dropped from a height of three feet to strike the ball at a point one-half inch off the top center point. The guillotine biade is guided during the drop by means of a substantially friction-free vertical track. Optionally, but not necessarily, the test can be repeated on the same or on different sections of the ball. Ball failure is defined as permanent damage evidenced by a cut or by removal of a segment from the ball surface.

Having generally described the invention, the following examples are included for purposes of illustration so that the invention may be more readily understood and are in no way intended to limit the scope of the invention unless otherwise specifically indicated.

EXAMPLE 1

Two-Piece Golf Ball with Cured Plastomer Cover

EXACT 4049 resin and Trigonox 17/40 were mixed in a ratio of 100 parts by weight EXACT 4049 per 5 parts by weight of Trigonox 17/40. The mixture was sheeted out to form a thin sheet having a thickness of approximately 3/16". A disc of the material was pressed into half shells using 0.812 inch radius male and 0.865 inch radius female smooth cavities. The half shells were compression molded using five minutes of steam followed by six minutes of cooling water. The heating time and temperature were insufficient to cure the EXACT resin.

Pairs of half shells were compression molded around 1.545" ground centers in 1.725 inch dimpled cavity molds. Molding took place in the lab using a single cavity mold to which was applied 15 minutes of steam followed by 15 minutes of cooling water. The balls were subjected to the Guillotine Cut Test. The balls did not cut but left a small mark on the surface. The cover had a Shore D hardness of 25. Although it was determined that either a larger center or smaller diameter shells for the cover should have been used, this example shows that cured EXACT 4049 can be used as a golf ball cover material.

EXAMPLE 2

One-Piece Golf Balls Using Cured Plastomers

Example 2A 1,200 grams of EXACT 5010 were mixed with Trigonox 17/40 in a weight ratio of 100 parts by weight EXACT 5010 per 5 parts by weight Trigonox 17/40. The stock was mixed in a lab Banbury mixer. Slugs were formed and were compression molded using 20 minutes of steam at 320° F. followed by 12 minutes of cooling water. The resulting one-piece golf balls had an 80 inch rebound from a 100 inch drop and passed the Guillotine Cut Test.

Examnle 2B 1,200 grams of EXACT 4005 were mixed with Trigonox 17/40 at a weight ratio of 100 parts by weight EXACT 4005 per 5 parts by weight Trigonox 17/40. Slugs were formed and were compression molded for 20 minutes using a 320° F. mold temperature followed by 10 minutes of cooling water. The resulting golf balls had good rebound and a compression that was too soft to measure on an Atti machine. This low compression could be increased by adding co-agents and reinforcing fillers. The balls had a weight of 35.4 grams. The Guillotine Cut Test resulted in a mark but did not cut through the surface.

EXAMPLE 3

One-Piece Golf Balls Comprising Cured Plastomer and Other Additives

Example 3A

The mixture shown below was prepared:

| Component | Parts by Weight |
|---|---|
| DOW XUR-1567-48562[1] (metallocene catalyzed polyolefin) | 100 |
| Zinc oxide[2] | 5 |
| HiSil 243 LD[3] | 10 |
| Zinc dimethacrylate[4] | 32 |
| $TiO_2$[5] | 2 |
| Trigonox 17/40 | 5 |
| | 154 |

[1]Dow Chemical, Midland, MI
[2]Zinc Corporation, Monaca, PA
[3]PPG, Pittsburgh, PA
[4]Sartomer Co., Exton, PA
[5]DuPont, Wilmington, DE The composition was mill mixed, formed into slugs and then compression molded using 15 minutes of steam at 310°

F. followed by 10 minutes of cooling water. The one-piece golf balls had a weight of 43.2 grams, an Atti compression (PGA compression) of 25 and a rebound of 64 inches when dropped from 100 inches. The golf balls passed the Guillotine Cut Test and would be useful as driving range golf balls.

Example 3B

The one-piece golf ball composition shown below was prepared in a lab Banbury® mixer:

| Component | Parts by Weight |
|---|---|
| EXACT 5010 | 100 |
| Zinc oxide[1] | 5 |
| Zinc diacrylate[2] | 30 |
| Stearic acid[3] | 1 |
| Limestone[4] | 10 |
| Trigonox 17/40 | 5 |
| | 151 |

[1]Zinc Corporation, Monaca, PA
[2]Rockland React-Rite, Rockmart, GA
[3]Harwick Chemical, Akron, OH
[4]Lee Lime, Lee, MA The material was formed into slugs and compression molded for 20 minutes at 320° F. using steam. All the balls had a soft compression of O Atti (0 PGA) and exhibited a very high rebound of 78–80 inches when dropped from 100 inches. The golf balls weighed 41.6 grams and passed the Guillotine Cut Test.

Example 3C

A one-piece golf ball was formed from the ingredients shown below:

| Component | Parts by Weight |
|---|---|
| High cis polybutadiene[1] | 80 |
| EXACT 4049 | 20 |
| Zinc dimethacrylate[2] | 32 |
| Zinc oxide[3] | 5 |
| Hi Sil 233 | 10 |
| $TiO_2$[4] | 2 |
| Vanox 1290[5] | 0.25 |
| Trigonox 17/40 | 3 |
| | 152.25 |

[1]Cariflex BR-1220, Muehlstein, Leominster, MA
[2]SR-365-C, Sartomer Company, Exton, PA
[3]Zinc Corporation, Monaca, PA
[4]Dupont, Wilmington, DE
[5]R.T. Vanderbuilt, Norwalk, CT The polybutadiene and EXACT 4049 were fluxed in a lab Banbury®-type mixer and remaining ingredients added for about 10 minutes. Slugs were formed and were compression molded for 14 minutes using steam at 310° F. followed by 10 minutes of cooling water. The golf balls had an Atti compression (PGA compression) of 75–80, a weight of 45.2 grams and passed the Guillotine Cut Test.

EXAMPLE 4

One-Piece Golf Balls Formed From Crosslinked Blends of Plastomer and Ionomer

Example 4A 900 grams of EXACT 5010 were mixed with lotek 8000 and Trigonox 17/40 in amounts of 60 parts by weight EXACT 5010, 40 parts by weight of lotek 8000 and 5 parts by weight of Trigonox 17/40. Not all of the Trigonox was mixed into the batch because a portion of it was caked to the rotor. Slugs were formed and were compression molded into one-piece golf balls by compression molding for 16 minutes at a steam temperature of 320° F. followed by 15 minutes of cooling using cooling water. The balls had an Atti compression (PGA compression) of 50, a weight of 37.0 grams, and passed the Guillotine Cut Test.

Example 4B

Example 4A was repeated with the exception that 45 parts by weight of limestone was added to the golf ball mixture and the compression molding time was increased to 20 minutes. The golf balls had an Atti compression (PGA compression) of 80, a weight of 45.7 grams, and a fair rebound rate.

EXAMPLE 5

Golf Ball Cores Formed From Cured Plastomer

Example 5A

Cured Plastomer Cores

Golf ball centers were formed using 100 parts by weight EXACT resin of various types and 5 parts by weight Lupersol 230XL peroxide, which is n-butyl-4,4 bis (t-butyl peroxy) valerate (Elf Atochem North America, Philadelphia, Pa.). The golf ball centers were cured for 20 minutes using steam at 320° F., followed by cooling water for 10 minutes. The resulting properties of the golf ball centers are shown on Table 1 below:

TABLE 1

EXACT Resin Cores
Compression Molded with 5 Parts by Weight 230XL Peroxide
(based upon 100 Parts by Weight of EXACT Resin)

| Type of EXACT Resin | Diam. at Pole inches | Diam. at Equator inches | Wt. gms | Riehle Comp.[1] | COR | Hardness Shore D | Hardness Shore C |
|---|---|---|---|---|---|---|---|
| 3024 | 1.505 | 1.525 | 27.2 | 83 | .542 | 42 | 75 |
| 3025 | 1.503 | 1.525 | 27.3 | 96 | .520 | 45 | 78 |
| 3027 | 1.508 | 1.530 | 27.3 | 69 | .567 | 43 | 70 |
| 3031 | 1.495 | 1.550 | 27.3 | 78 | .550 | 43 | 73 |
| 4011 | 1.520 | 1.535 | 27.3 | 29 | .662 | 35 | 55 |
| 4049 | 1.535 | 1.545 | 27.3 | —[2] | .687 | 22 | 35 |
| 5010 | 1.532 | 1.545 | 27.3 | —[2] | .678 | 15 | 27 |

[1]160 minus Riehle compression equals PGA compression.
[2]Too soft to measure compression.

As shown on Table 1, different types of plastomers were cured using the same quantity of peroxide, resulting in golf ball cores having varying values of compression, coefficient of restitution, and hardness. The "best" core of those shown above for making a golf ball with good distance is the core made with EXACT 4049 because it has the highest coeffeicient of restitution. However, if a restricted flight golf ball is desired, the covered ball preferably has a COR in the range of 0.560 to about 0.670, as is further described in U.S. Pat. No. 5,209,485, the contents of which are incorporated herein by reference.

Example 5B

Cured Cores Containing EXACT 4049

A set of golf balls was made using 100 parts by weight EXACT 4049, 45 parts by weight zinc oxide and 10 parts by weight Lupersol 231 XL (Elf Atochem North America), which is 1,1-bis-(t-butylperoxy)-3,3,5-trimethylcyclohexane. The cores were compression molded for 13 minutes using steam at 320° F. The cores passed the Guillotine Cut Test and had the following average properties:

weight: 36.8 g compression: too soft to measure

COR: 0.660

Shore C/D (ASTM D-2240): 49/32

A number of the cores were electron beam treated at a dosage of 8 megarads and a voltage of 10 million electron volts in an effort to cure the cores. This condition of electron beam treatment was intended to penetrate through the entire thickness of the core. Electron beam treatment resulted in a reduction in COR to 0.635. Compression remained too soft to measure. It is expected that compression could be brought to an appropriate level through the use of coagents and reinforcing fillers. The guillotine cut resistance of the cores increased from a rating of "good" (prior to treatment) to "very good" (after treatment) as a result of electron beam treatment.

Example 5C

Cured Cores Containing lotek—EXACT Blend

A set of golf ball cores was made using 35 parts by weight lotek 8000, 65 parts by weight EXACT 4049, 10 parts by weight Kraton FG, (a styrene-butadiene block copolymer sold by Shell), 40 parts by weight zinc oxide, and 10 parts by weight of Lupersol 231 XL. The cores were compression molded for 13 minutes using steam at 320° F. The cores passed the Guillotine Cut Test and had the following average properties:

weight: 36.8 g

Riehle compression: 84

COR: 0.661

Shore CID (ASIM D-2240): 75/47

A number of t he cores were electron beam treated under the same conditions as were used for the cores of Example 5B. The treated cores had a COR of 0.652 and a Riehle compression of 88. The guillotine cut resistance of the cores increased from "very good" to "excellent" as a result of electron beam treatment.

EXAMPE 6

Golf Ball Cores Formed From Uncured and Electron Beam Treated Plastomer

A number of 1.545 inch golf ball cores were made using EXACT resins compounded without peroxide. A warm soft slug for each core was heated 4 mins @ 320 then cooled for 10 minutes using cooling water. All of the uncured cores passed the Guillotine Cut Test.

A number of the cores were electron beam treated using the same conditions as were used for the cores of Example 5B. The formulations and properties of the molded cores before and after electron beam treatment are shown on Table 2.

While the compression of the balls of Examples 6-1 and 6-2 was too soft to measure, it is believed that the compression values could be brought to an appropriate level by adding coagents and reinforcing fillers. As in Example 5B, the electron beam treatment was intended to penetrate the entire thickness of the core. If a lower voltage and/or dosage of electron beam treatment were used, this could have produced a smaller reduction in COR while still obtaining the type of improvement of cut resistance which was achieved in Examples 6-1 to 6-4.

Furthermore, the use of free radical scavengers could have resulted in less of a reduction in COR. The electron beam treated formulations of Example 6, and modifications thereof, would be useful for forming durable one-piece restricted flight golf balls.

TABLE 2

| Composition (parts by wt.) | 6 - 1 | 6 - 2 | 6 - 3 | 6 - 4 |
|---|---|---|---|---|
| EXACT 4049 | 100 | 100 | 65 | 65 |
| Iotek 8000 | — | — | 35 | 35 |
| Zinc oxide | — | 45 | 10 | 40 |
| Kraton FG[1] | — | — | — | 10 |
| weight (g) | 27.4 | 37.5 | 29.0 | 37.8 |
| Riehle comp. of untreated cores | —[2] | —[2] | 119 | 89 |
| Riehle comp. of treated cores | —[2] | —[2] | 129 | 95 |
| COR of untreated cores | 0.676 | 0.642 | 0.675 | 0.645 |
| COR of treated cores | 0.655 | 0.608 | 0.664 | 0.641 |
| Shore C/D (ASTM D-2240) | 40/26 | 44/30 | 63/40 | 72/44 |
| Guillotine cut resistance of untreated cores | good | fair | very good | good |
| Guillotine cut resistance of treated cores | very good | good | excellent | very good |

[1]Styrene-butadiene block copolymer (Shell)
[2]Too soft to measure

As shown in Examples 1–6, metallocene catalyzed polyolefins can be used in golf ball cores and covers, and to form one-piece golf balls as long as sufficiently high values of COR, cut resistance and compression are achieved.

While certain representative embodiments and details of the present invention have been shown for the purposes of illustrating the invention, it will be apparent to those skilled in the art that various changes and modifications may be made therein without departing from the spirit or scope of the invention.

What is claimed is:

1. A one-piece golf ball comprising a plastomer having a molecular weight distribution of 1.5 to 4 prior to crosslinking and a composition distribution breadth index of greater than 30% prior to crosslinking, the plastomer in at least the outer surface portion of the ball being crosslinked, the ball having a coefficient of restitution of at least 0.600.

2. A golf ball according to claim 1, wherein the plastomer is crosslinked throughout the entire thickness of the ball.

3. A golf ball according to claim 1, wherein the ball has a coefficient of restitution of at least 0.740.

4. A golf ball according to claim 1, wherein the plastomer includes a copolymer of ethylene and at least one $C_3$–$C_{20}$ α-olefin.

5. A golf ball according to claim 1, wherein the plastomer includes a copolymer of ethylene and at least one $C_4$–$C_8$ α-olefin.

6. A golf ball according to claim 1, wherein the plastomer includes a terpolymer of ethylene, butene and hexene.

7. A golf ball according to claim 1, wherein the ball has a cut resistance sufficient to pass the Guillotine Cut Test.

8. A golf ball according to claim 1, wherein the one-piece ball has a cut resistance sufficient to pass the Guillotine Cut Test.

9. A golf ball according to claim 1 wherein the plastomer is crosslinked using a curing agent which includes at least one member selected from the group consisting of di-tert-butyl peroxide, dicumyl peroxide, benzoyl peroxide, 2,4-dichlorobenzoyl peroxide, t-butyl-cumyl peroxide, t-butyl perbenzoate, t-butyl peroxide, t-butylperoxy(2-ethyl hexanoate), 2,5-dimethyl-2,5-di(benzoylperoxy)-hexane, benzoyl peroxide, 2,5-dimethyl-2,5-(t-butyl peroxy)-hexane, 1,1-di-t-butyl peroxy-3,3,5-trimethylcyclohexane, 4,4-di-t-butyl peroxy n-butyl valerate, and 4,4 bis(tert-butylperoxy) butylvalerate.

10. A golf ball according to claim 9 wherein said curing agent is 4,4 bis(tert-butylperoxy)butylvalerate having a peroxide content of about 40%.

11. A golf ball according to claim 1, wherein the ball further comprises an elastomer.

12. A golf ball according to claim 1, wherein the plastomer is formed from ethylene and at least 1–32 wt % of comonomer.

13. A golf ball according to claim 1, wherein the plastomer has a composition distribution breadth index of at least 45%.

14. A golf ball according to claim 11, wherein the ball further comprises a metal oxide.

15. A golf ball according to claim 14, wherein the metal oxide comprises zinc oxide.

16. A golf ball according to claim 14, wherein the ball further comprises at least one member selected from the group consisting of zinc diacrylate and zinc dimethacrylate.

17. A golf ball according to claim 15, wherein the ball further comprises at least one member selected from the group consisting of zinc diacrylate and zinc dimethacrylate.

18. A golf ball according to claim 1, wherein the ball further comprises a metal oxide.

19. A golf ball according to claim 18, wherein the metal oxide comprises zinc oxide.

20. A golf ball according to claim 18, wherein the ball further comprises at least one member selected from the group consisting of zinc diacrylate and zinc dimethacrylate.

21. A golf ball according to claim 19, wherein the ball further comprises at least one member selected from the group consisting of zinc diacrylate and zinc dimethacrylate.

22. A golf ball according to claim 1, wherein the ball further comprises an ionomer.

23. A golf ball according to claim 22, wherein the plastomer is crosslinked throughout the entire thickness of the ball.

24. A golf ball according to claim 1, wherein at least the outer surface portion of the ball is crosslinked by irradiation.

25. A golf ball according to claim 1, wherein the ball further comprises at least one co-agent selected from the group consisting of zinc diacrylate; zinc dimethacrylate; zinc monomethacrylate; trimethylol propane triacrylate; trimethylol propane trimethacrylate; vinyl, allyl, methallyl, furfuryl, crotyl and cinnamyl esters of the following acids: oxatic, maioic, succinic, glutaric, adipic, pinelic, suberic, azelaic, sebacic, maleic, itaconic, citraconic, mesaconic, fumaric, aconitic, phthalic, isophthalic, terephthalic, naphthalene, dicarboxylic mellitic, pyromellitic, trimesic, acrylic, methacrylic, cennamic, and crotonic; di- and triallyl cyanurate; di- and triallylmelamine; divinyl benzene; diallylbenzene; diallylamine; allyl ether; allyl gycolates; di, tri and tetravinyl and allyl silanes; polyamides and imides of maleic, itaconic, acrylic, methacrylic, crotonic, citaconic, aconitic and cinnamic acid; and polyol esters and anhydrides of acrylic methacrylic, contic, and cinnamic acids.

26. A golf ball according to claim 18, wherein the ball further comprises at least one co-agent selected from the group consisting of zinc diacrylate; zinc dimethacrylate; zinc monomethacrylate; trimethylol propane triacrylate; trimethylol propane trimethacrylate; vinyl, allyl, methallyl, furfuryl, crotyl and cinnamyl esters of the following acids: oxatic, maioic, succinic, glutaric, adipic, pinelic, suberic, azelaic, sebacic, maleic, itaconic, citraconic, mesaconic, fumaric, aconitic, phthalic, isophthalic, terephthalic, naphthalene, dicarboxylic mellitic, pyromellitic, trimesic, acrylic, methacrylic, cennamic, and crotonic; di- and triallyl cyanurate; di- and triallylmelamine; divinyl benzene; diallylbenzene; diallylamine; allyl ether; allyl gycolates; di, tri and tetravinyl and allyl silanes; polyamides and imides of maleic, itaconic, acrylic, methacrylic, crotonic, citaconic, aconitic and cinnamic acid; and polyol esters and anhydrides of acrylic methacrylic, contic, and cinnamic acids.

27. A one-piece golf ball comprising the reaction product of a plastomer with a molecular weight distribution of about 1.5–4 and a composition distribution breadth index of greater than 30% and a curing agent for the plastomer.

28. A golf ball according to claim 27, wherein said plastomer is a copolymer of ethylene and at least one $C_3$–$C_{20}$ $\alpha$-olefin.

29. A golf ball ac cording t o claim 27, wherein said plastomer is a copolymer of ethylene and at least one $C_4$-$C_8$ $\alpha$-olefin.

30. A golf ball according to claim 27, wherein the ball further comprises a metal oxide.

31. A golf ball according to claim 30, wherein the metal oxide comprises zinc oxide.

32. A golf ball according to claim 30, wherein the ball further comprises at least one member selected from the group consisting of zinc diacrylate and zinc dimethacrylate.

33. A golf ball according to claim 31, wherein the ball further comprises at least one member selected from the group consisting of zinc diacrylate and zinc dimethacrylate.

34. A golf ball according to claim 27, wherein the ball includes an outer surface portion, and at least the outer surface portion of the ball is crosslinked by irradiation.

35. A method of making a golf ball, comprising:

forming a golf ball product mixture comprising a plastomer with a molecular weight distribution of about 1.5–4 and a composition distribution breadth index of at least 30%, the quantity of plastomer being appropriate to form a golf ball product having a coefficient of restitution of at least 0.600, placing the reaction mixture in a mold to form a one-piece golf ball, and crosslinking at least the outer surface of the ball.

* * * * *